United States Patent [19]

Webb

[11] Patent Number: 4,513,726

[45] Date of Patent: Apr. 30, 1985

[54] FUEL SAVING SYSTEM FOR A GASOLINE ENGINE

[75] Inventor: Richard Webb, Pratville, Calif.

[73] Assignee: Misty Vapor, Inc., Orangevale, Calif.

[21] Appl. No.: 597,400

[22] Filed: Apr. 6, 1984

[51] Int. Cl.[3] ..... F02M 17/00

[52] U.S. Cl. ..... 123/523; 261/DIG. 83; 261/36 A; 261/98; 123/524

[58] Field of Search ..... 123/522, 523, 524, 557, 123/525, 575; 261/DIG. 83, 122, 94, 95, 98; 48/189.6

[56] References Cited

U.S. PATENT DOCUMENTS

| | | | |
|---|---|---|---|
| 2,415,619 | 2/1947 | Wichmann | 123/523 |
| 3,411,489 | 11/1968 | Kruger | 123/523 |
| 4,366,797 | 1/1983 | Jackson | 123/523 |
| 4,412,521 | 11/1983 | Silva | 123/524 |
| 4,426,984 | 1/1984 | Gilbert | 123/522 |

*Primary Examiner*—Ronald H. Lazarus

*Attorney, Agent, or Firm*—Mark C. Jacobs

[57] ABSTRACT

A fuel saving system for a gasoline engine including a chamber for mixing air and gas and passing the vaporized fuel into an intake manifold to create a better balanced fuel mixture in the engine combustion chambers. The mixing chamber draws air from the engine's vacuum, passing it through an elastic porous element where raw gas is sprayed directly on the element and vapor is drawn off and passed into the intake manifold where it is mixed with air.

9 Claims, 7 Drawing Figures

FUEL SAVING SYSTEM FOR A GASOLINE ENGINE

BACKGROUND OF THE INVENTION

1. Field of the Invention

The invention relates to fuel saving systems; and, more particularly, to a device used in conjunction with a conventional gasolene engine carburetor to provide a better balanced fuel mixture to the combustion chamber.

2. Description of the Prior Art

Conventional spark ignition internal combustion engines employ an air and fuel mixing and distribution system comprising a carburetor for mixing air and fuel and an intake manifold for distributing the mixture to the combustion cylinders. A combustible fuel and air mixture is formed in the carburetor by drawing air through a venturi where fuel is drawn into and mixed with the air. It is well known that the fuel and air mixture formed in conventional carburetors, however, is not an ideal mixture since the fuel is sprayed into an air stream in the form of a mist or small droplets. It is also well known that the efficiency of an internal combustion engine, i.e., the amount of work produced in terms of fuel consumed, is partially dependent upon the degree to which the fuel is dispersed in the air. Therefore, if the fuel is completely vaporized prior to injection into the combustion chamber of the engine, combustion thereof is more complete, thus resulting in higher efficiency. Furthermore, more complete combustion of the fuel lowers the concentration of hydrocarbon and carbon monoxide emissions from the engine.

Various fuel saving devices have been suggested in the past. Generally speaking, such devices have not been successful since they may require some engine modification, thus possibly voiding the warranty on the vehicle, or are very complex and expensive. In addition, fuel saving claims using such devices have always been suspect. One such system that drastically replaces the conventional fuel pump and carburetor is disclosed in U.S. Pat. No. 4,015,570 to Sommerville. Fuel being inducted into the engine cylinders should be completely vaporized prior to combustion. This complete vaporization has always been a problem in the prior art.

SUMMARY OF THE INVENTION

It is an object of this invention to provide an improved system wherein a balanced ratio of fuel and air is admitted to the combustion chambers of an internal combustion engine while allowing a lesser amount of air to be drawn through the carburetor of the engine.

It is a further object of the invention to carry out the foregoing device by allowing air and vapor to be pulled into the intake manifold of the engine underneath the carburetor thereof thus creating less air coming down through the carburetor.

It is a further object of this invention to carry out the foregoing objects to produce a vapor prior to admitting the same into the intake manifold by using the engine vacuum to draw air through an elastic porous element while spraying raw fuel onto the element to form a mist.

These and other objects are preferably accomplished by providing a fuel saving system for a gas engine having a chamber for mixing air and gas and passing the vaporized fuel into the intake manifold to create a better balanced fuel mixture in the engine combustion chambers. The mixing chamber draws air from the engine's vacuum, passing it through an elastic porous element where raw gas is sprayed directly onto the element and vapor is drawn off and passed into the intake manifold.

DESCRIPTION OF THE PREFERRED EMBODIMENT

Figure 1:
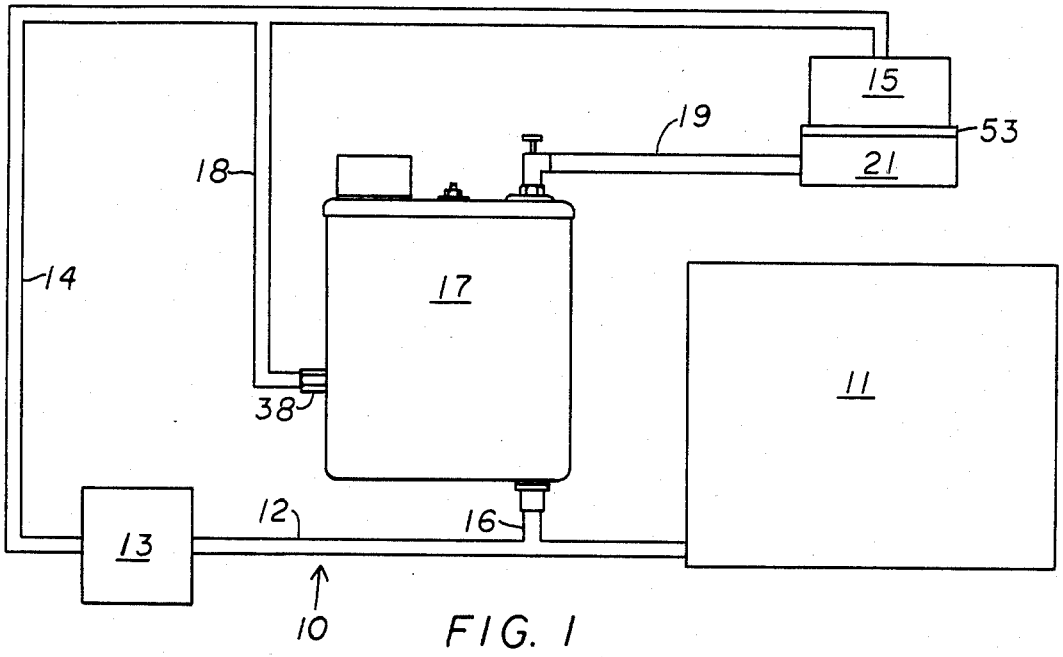
FIG. 1 is a schematic illustration of a fuel saving system in accordance with the teachings of the invention.

Referring now to FIG. 1 of the drawing, a system 10 is shown which may be installed on a vehicle. System 10, as will be evident, is a conventional internal combustion engine with modifications in accordance with the invention as disclosed herein. However, it is to be understood that system 10 utilizes conventional components except wherein disclosed as part of the invention.

Thus, a conventional gas tank 11 is provided coupling via conduit 12 to a conventional fuel pump 13. Fuel pump 13 is in turn coupled via conduit 14 to a conventional carburetor 15.

A conduit 16 interconnects conduit 12 (and thus fuel pump 13 and gas tank 11) to apparatus 17 (see also FIG. 2), as will be disclosed further hereinbelow. A conduit 18 interconnects apparatus 17 with conduit 14 (between fuel pump 13 and carburetor 15). Conduit 19 from apparatus 17 inputs into a plate 21 mounted beneath carburetor 15 which plate 21 is a part of the intake manifold and which plate is in communication with the interior of carburetor 15 again for reasons to be discussed further hereinbelow.

Figure 2:
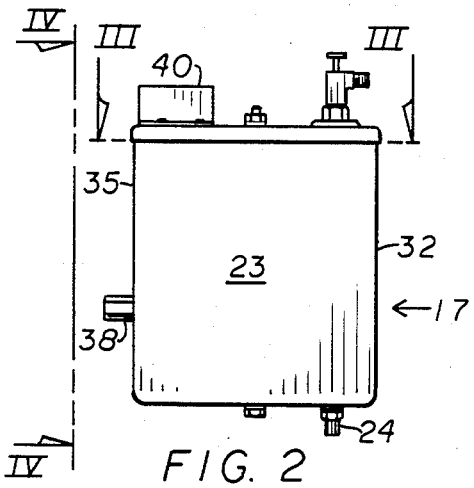
FIG. 2 is a vertical view of one component of the system of FIG. 1 removed therefrom.
Figure 3:
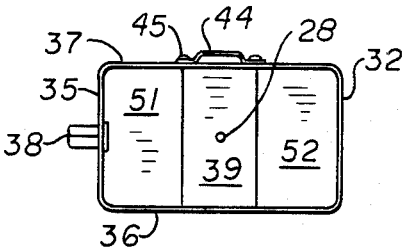
FIG. 3 is a view taken along lines III—III of FIG. 2.
Figure 5:
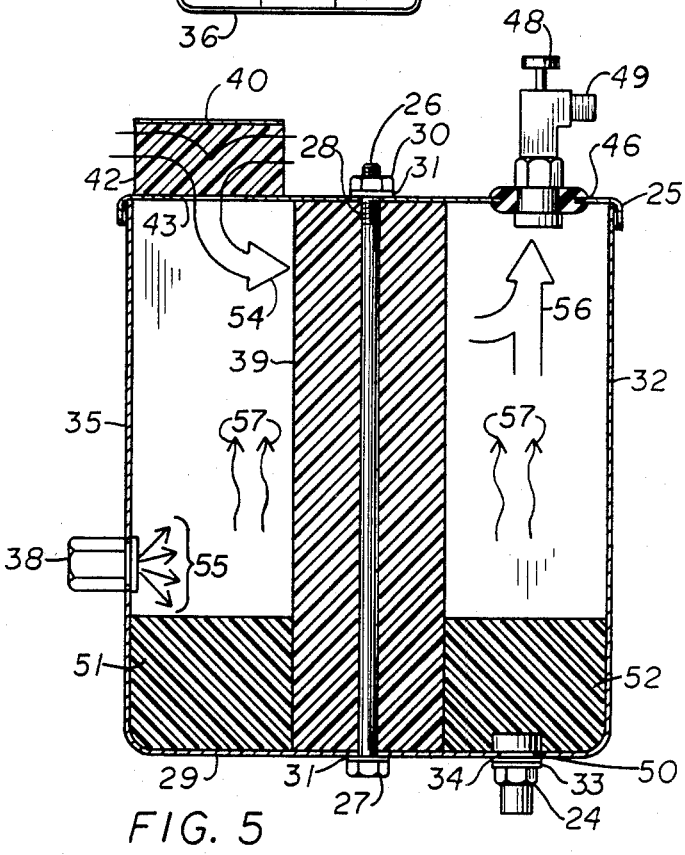
FIG. 5 is a vertical sectional view in section, of the component of FIG. 2.

Referring now to FIG. 2, apparatus 17 is shown removed from system 10 of FIG. 1. Apparatus 17 includes a main body housing 23 having a one-way ball check valve 24 at the bottom thereof communicating with the interior thereof through a drain hole 50 in bottom wall 29 (see particularly FIG. 5). As also seen in FIG. 5, housing 23 includes an open chamber closed off by a lid or cover 25. An elongated bolt 26 having a head 27 and threaded shaft 28 extends up from bottom wall 29 through an aperture in the top cover 25 where nut 30 is threaded thereon. A washer 31 may be provided between head 27 and wall 29 and between nut 30 and cover 25 as shown. As seen in FIG. 3, the shaft 28 is generally centrally located in housing 23.

Check valve 24 is preferably a threaded fitting threaded into an opening in the bottom wall 29 spaced about one inch from the side wall 32. A conventional washer 33 and gasket 34 may be provided.

Figure 6:
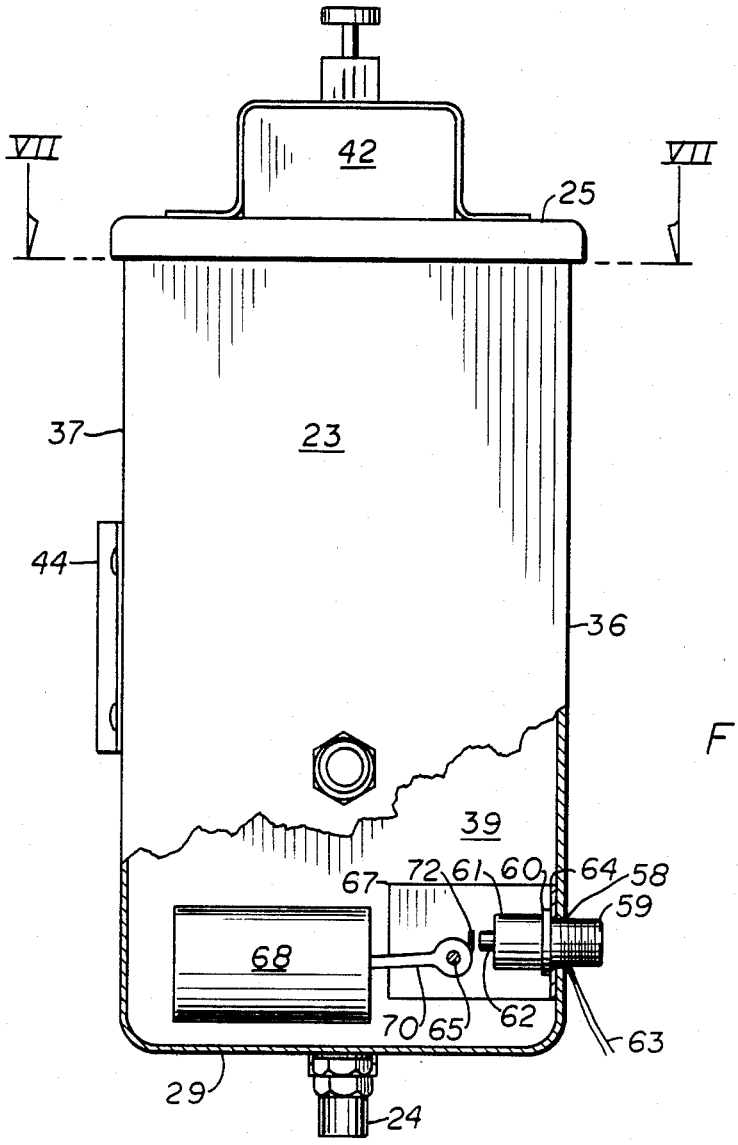
FIG. 6 is a view taken along lines VI—VI of FIG. 5 showing a modification thereof.

As seen in FIG. 6, housing 23 may be rectangular having the aforementioned bottom wall 29, side walls 32,35 and front and back walls 36,37, respectively.

A fuel mist valve 38 is provided in side wall 32 coupled to conduit 18 (see FIGS. 1 and 2).

An elongated porous elastic element, such as a sponge 39, is provided internally of housing 23 and, as seen in FIG. 3, has shaft 28 extending threethrough (and, of course, sponge 39 surrounds shaft 28). As seen in FIG. 5, sponge 39 extends from bottom wall 29 to top cover 25.

Figure 4:
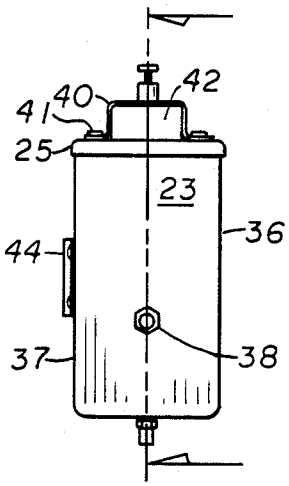
FIG. 4 is a view taken along lines IV—IV of FIG. 2.

As seen in FIGS. 4 and 5, a U-shaped flange 40 on the upper surface of cover 25 at one end may be removably secured to cover 25 by suitable screws 41 or the like. Of course, flange 40 may be spot welded or riveted to cover 25. A sponge 42, similar to sponge 39, is disposed internally of flange 40 as shown. A hole or aperture 43 is provided in cover 25 communicating with the sponge 42 for reasons to be discussed. As seen in FIG. 4, the flange 40 is open to the atmosphere so that sponge 42 is also open to the atmosphere. The opposite side of flange 40 in FIG. 4 is also open to the atmosphere and, in this manner, sponge 42 may be quickly and easily removed from, or inserted in, flange 40 from either side thereof.

As seen in FIG. 3, a U-shaped flange 44 is provided on back wall 37 for connection to a mounting strap (not shown) as will be discussed. Flange 44 may be removably secured to wall 37 by suitable screws 45, if desired. Of course, flange 44 may be spot-welded or riveted to wall 37.

Another opening or hole 46 (FIG. 5) is provided in cover 25 at the end thereof opposite hole 43. The bolt 26 and holes 43,46 may be centrally located on cover 25 and lie along the central longitudinal axis of cover 25. A resilient grommet 47 is mounted in hole 46 and a pressure control valve 48 terminating in threaded end 49 is mounted in grommet 47 thus communicating the interior of housing 23 with the carburetor 15 (FIG. 1) of the vehicle via conduit 19.

As seen in FIG. 3, sponge 39 extends across the shorter axis of housing 23 and, as seen in FIG. 5, extends from the top to the bottom thereof. A pair of sponge filters 51,52 (FIG. 5) are also disposed in housing 23 on both sides of sponge 39 again for reasons to be discussed.

The apparatus disclosed herein may be of any suitable materials and dimensions. For example, housing 23 may be of plastic or aluminum about 7" in height, 6½" wide and about 4" in depth. If desired, a gasket (not shown) may be provided between cover 25 and housing 23. Although bolt 26 has been disclosed as insertible through bottom wall 29, it may be a 174 in. bolt welded interiorly thereof at the dead center of bottom wall 29. Holes 43 and 46 may be about 1 in. in diameter and about ⅝ in. from the side walls 32,35.

The flange 40 may be about 2 in. in both length and width and about 1 in. high. Drain hole 50 may be about 7/16 in. in diameter and about 1 in. from wall 32. The mounting flange 44 may be about 2 in. by 2 in. and is adapted to receive a mounting strap (not shown) bolted or otherwise secured to the vehicle so that housing 23 and its components need only be slid onto the mounting strap, the strap engages the spacing between flange 44 and back wall 37 (this spacing is of course related to the thickness of the mounting strap-e.g., about ⅛ in).

Any suitable valving may be used. For example, the misting valve 38 may be the fogger-type valve manufactured by Banmac Corp. of St. Louis, Mo.

Although valve 38 may be at any suitable location, it has been found that its exact location can affect the air-fuel ratio. Thus, it is preferred that the valve 38 be mounted, in the housing 23 of the size previously indicted, about 2 and ½ in. up side wall 35 along the centerline. thereof. Any suitable oneway check valve 24 may be used, such as the one manufactured and sold by the Weatherband Corp. Valve 24 allows the fuel pump 13 (FIG. 1) to suck gas but it only works in one direction. Valve 48 is any conventional pressure control valve and controls the total output of vapor which thereby controls the air input through hole 43 due to the size thereof.

The specific sponges used in housing 23 are of three different types. Sponges 51,52 are of polyester and absorb excess mist gases formed in housing 23 and is not air permeable so as to prevent air in the housing 23 from being sucked thereout by fuel pump 13. Sponge 39 is also of polyester and is air and mist permeable. Sponge 42 is also of polyester, of lesser density than sponges 39 and 52, and of the type used in conventional filters for smog devices and air filter spaces. Sponge 42 is air and mist permeable.

The sponges used herein may be of the type manufactured and sold by Armley Sponge Co. of Detroit, Mich. For example, sponges 51,52 may be part no. 13500; sponge 42 may be part no. 139600 and sponge 39 may be part no. 139500Z, all sold by Armley Sponge Co. Sponge 39 is about 7 in. tall, may be about 2 in. by 4.25 in. in width and breadth. Sponges 51,52 may be about 2 in. high and about 4 in. wide and 1.5 in. in breadth. Sponges 51,52 act as baffles to prevent the shocking of fuel entering housing 23. Sponge 42 may be about 2 in. by 2 in. by 1 in. in length, width and breadth.

Referring again to FIG. 1, plate 21 is also of any suitable material, such as asbestos, phenol resin or aluminum alloy. A gasket 53, e.g., one about 178 in. thick, may be provided between carburetor 15 and plate 21. Carburetor 15 is not otherwise modified or altered.

In operation, referring again to FIG. 1, ambient air is drawn into flange 40 through sponge 42 and against and through sponge 39 which acts as a wick (see arrow 54 in FIG. 5). Raw fuel is pumped from gas tank 11 via fuel pump 13 through conduit 14 and conduit 18 into spray valve 38 where the fuel is sprayed directly onto sponge 39 in the form of an extra fine mist (see arrows 55 in FIG. 5).

Vapor is prodcued in housing 23 by the admixture of fuel and air and flows, as indicated by arrow 56, up within housing 23 and out through valve 48. Excess fuel which is not vaporized settles to the bottom of housing 23 through sponge 51 which acts as both a baffle for the incoming fuel and as a filter. Sponge 52 also acts as a filter and both sponges permit the fuel deposited at the bottom of housing 23 to be drawn out the drain hole 50 and valve 24 by the fuel pump 13. Since valve 24 is a one-way valve, no air is sucked back into housing 23 through valve 24. Thus, the fuel withdrawn from housing 23 flows back into tank 11 where it can be recirculated by pump 13 to apparatus 17. As seen in FIG. 5, and indicated by arrows 57, vaporized fuel also rises from sponges 51,52 and exits housing 23 at arrow 56.

The surface area of the sponge 39 through which the incoming air is passing through is much greater than the size of the sponge 39 since it is very porous. Thus, vapor is being drawn off of a much larger area in reality than the overall size of the sponge 39 itself.

Air entering carburetor 15 passes into mixing plate 21 where it mixes with the incoming vapor. This mixture of vapor and air enters the plate 21 below carburetor 15 in a more suitable and balanced ratio of fuel and air than in known prior art arrangements. Thus, this preferred ratio of fuel and air is admitted into each combustion chamber of the vehicle while allowing less air to be drawn through carburetor 15. Since less air is drawn through carburetor 15, less raw fuel is distributed to the engine of the vehicle.

Plate 21 thus acts as an intake manifold and the air-fuel mixture, such as 1 part raw fuel to 14 parts air, is admitted to the combustion chambers as shown in FIG. 1.

Valve 48 is operated to control the total output of vapor from housing 23 thus controlling the input into chamber 19. Since the amount of air admitted into carburetor 15 is controlled by the size of the opening in the throat of the carburetor 15, the desired 1:14 fuel-air mixture is easily obtained. Since vapor is now created underneath carburetor 15 and not within the carburetor 15, as in conventional systems, a better balanced fuel mixture is created. In conventional carburetors, the air is drawn down the throat of the carburetor, passes over the venturis therein, creates a vacuum in the venturis while pulling raw fuel into the carburetor throat. This mixture then passes through the intake manifold and into the combustion chamber where only 174th of the raw fuel has been vaporized. This of course is quite inefficient and wastes fuel.

Although a pair of sponges 51 and 52 have been provided, one of the sponges, such as sponge 51, may be eliminated and a float may be provided, coupled to valve 24, for detecting the level of fuel at the bottom of housing 23 and selectively drawing off the same when necessary. This is particularly useful since 70% of the fuel entering housing 23 may be deposited therein when the vehicle engine is at idle.

Figure 7:
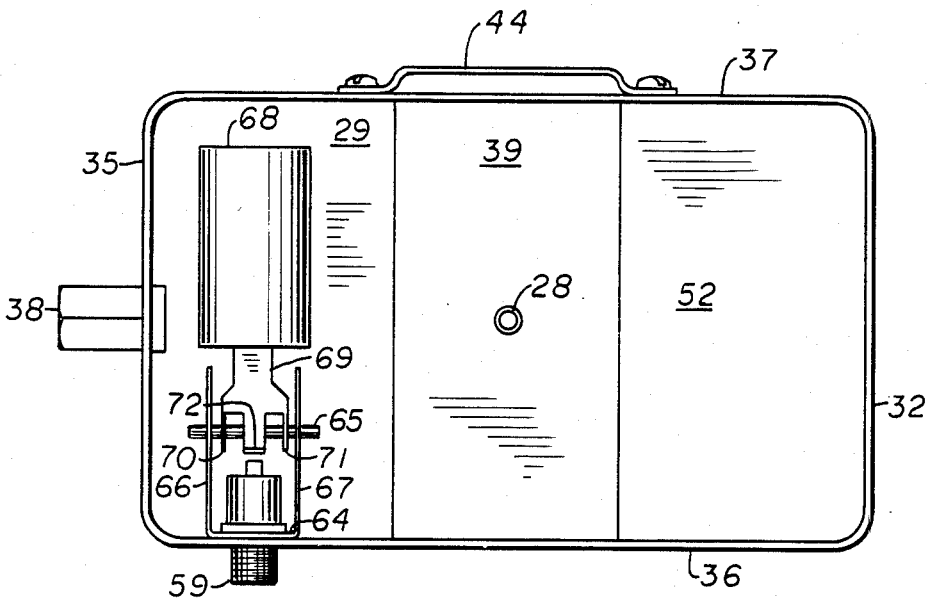
FIG. 7 is a view taken along lines VII—VII of FIG. 6.

This is illustrated in FIGS. 6 and 7 wherein like parts relate to like parts of the embodiment of FIGS. 1 to 5. It is also to be understood that the embodiment in FIGS. 6 and 7 includes all of the elements and components of the embodiment of FIGS. 1 to 5 other than sponge 51. Thus, a hole 58 is provided in front wall 36 a predetermined distance from the bottom thereof, such as a 5/16th of an inch diameter hole about 1 in. up from bottom wall 29 and about 1 in. from side wall 35. A threaded fitting 59 is mounted in hole 58. Hole 58 may be a threaded hole and a nut, not shown, if desired, may be threaded on fitting 59. Suitable washers or gaskets (not shown) may also be provided.

Fitting 59 has a flange 60 abutting wall 36 on the interior of housing 23 and a main body portion 61 and a detector 62 which may be coupled, via electrical conduit 63, to aforementioned valve 24 as is well known in the art. A U-shaped flange 64 is held against wall 36 by flange 60 and a shaft 65 is fixedly mounted between the spaced arms 66,67 of flange 64. A float 68 is provided having an extension portion 69 with spaced arms 70,71 having shaft 65 extending through aligned apertures therein so that extension portion 69 is rotatably mounted on shaft 65. An indicating finger 72 is mounted at the terminal end of portion 69 and extends upwardly as shown in FIG. 6.

In FIG. 6, the float 68 is shown at rest. It can be appreciated that, as fuel fills housing 23, float 68 will move upwardly and counterclockwise about shaft 65. When finger 72 engages sensor 62, a signal is sent to valve 24 via conduit 63 and valve 24 is activated to drain fuel from housing 23. When float 68 returns to the FIG. 6 position, sensor 62 is disengaged and valve 24 is deactivated to stop the flow of fuel. In this manner, fuel can be quickly and easily automatically removed from housing 23 when necessary.

In actual installation of the apparatus in acoordance with the teachings of this invention, it was found that a 20 to 25% increase in miles per gallon was obtained. The apparatus has been in use in one installation for over 10,000 miles with no problems.

In rigidly controlled tests carried out by a testing lab, there was an average gain of 6.3% in fuel savings with considerably improved throttle response.

It can be seen that the installation of the apparatus of the invention results in considerable savings in fuel and increased throttle response.

The primary advantage of the instant invention lies in the elimination of a standard float, such as one would find in a carburetor. The valve is easier to adjust to ensure the desired 14:1 air-fuel mixture.

It is seen that the fuel intake is beneath the carburetor not above the carburetor. Thus only the air comes through the carburetor and the fuel and vapor mixture comes in at the bottom of the carburetor directly into the intake manifold. The vapor mixture is, of course, seen to be actually of fuel droplets and air.

In addition, the instant apparatus is seen to have a temperature lowering effect upon the engine, thus extending the engine's life.

I claim:

1. In a fuel system for a vehicle having a carburetor, a gas tank fluidly coupled to the carburetor and a fuel pump disposed between the tank and carburetor for controlling the flow of fuel to the carburetor, and fuel vaporizing means in said system for delivering vaporized fuel to the combustion chambers of said vehicle, the improvement which comprises:

said vaporizing means including a vaporizing chamber having a top wall and a bottom wall and side walls and a fluid conduit coupling said chamber to a fluid conduit interconnecting said fuel pump to said carburetor:

an air inlet at the top of said chamber opening into the interior of said chamber;

a valve-controlled fluid conduit at the top of said chamber spaced from said air inlet communicating the interior of the top of said chamber with said carburetor;

a plate disposed underneath said carburetor in fluid communication both with the interior of said carburetor, said plate also being in fluid communication with said combustion chambers;

a valve controlled drain line fluidly coupled to a drain hole at the bottom of said vaporizing chamber and to a fluid conduit fluidly coupling said fuel pump to said gas tank;

first porous means disposed in said vaporizing chamber extending from the bottom to the top thereof;

second porous means disposed at the bottom of said vaporizing chamber; and a valve controlled fuel mist spray inlet in fluid communication with said fluid conduit interconnecting said fuel pump to said carburetor opening into the interior of said vaporizing chamber below the air inlet and above said second porous means adapted to spray fuel in a mist onto said first porous means whereby vapors are adapted to be created when air enters into said vaporizing chamber and mixes with said mist, said vapors being adapted to flow upwardly in said vaporizing chamber and exit out through said valve-controlled fluid conduit to said plate under carburetor.

2. In the system of claim 1 wherein said first porous means is an elastic air and mist permeable sponge.

3. In the system of claim 2 wherein said second porous means is a mist permeable and air impermeable elastic sponge thereby preventing said fuel pump from sucking air out of said vaporizing chamber.

4. In the system of claim 1 including a third porous means disposed in said air inlet.

5. In the system of claim 1 wherein said second porous means is disposed on the bottom of said vaporizing chamber on the side of said first porous means remote from said mist spray inlet and below where said valve-controlled fluid conduit opens into said vaporizing chamber.

6. In the system of claim 5 including a third porous means on the bottom of said vaporizing chamber below said air inlet and said mist spray inlet adapted to act as a baffle for incoming fuel.

7. In the system of claim 5 including float means mounting in said vaporizing chamber above the bottom wall thereof and below said fuel mist inlet, said float means being coupled to said valve-controlled drain line.

8. In the system of claim 1 wherein said first and second porous means are of polyester material, said first porous means being an elongated sponge fixedly secured in said vaporizing chamber extending from the bottom wall to the top thereof along substantially the middle thereof.

9. In the system of claim 1 wherein said vaporizing chamber is generally rectangular having interconnected front and back walls and a pair of side walls being about 7 inches in height, $6\frac{1}{2}$ inches in width and about 4 inches in depth, said fuel mist inlet opening through one of said side walls and being about 2 and $\frac{1}{2}$ inches up from the bottom wall along substantially the middle axis of said side wall.

* * * * *